United States Patent [19]

Coonan

[11] Patent Number: 4,594,111

[45] Date of Patent: Jun. 10, 1986

[54] LIQUID PHASE CLEANER-SOLVENT

[76] Inventor: Edmund C. Coonan, 3029 Holme Ave., Philadelphia, Pa. 19136

[21] Appl. No.: 657,604

[22] Filed: Oct. 4, 1984

[51] Int. Cl.[4] ..... C23G 1/02; B08B 7/00; C11D 1/18; C11D 1/38

[52] U.S. Cl. ..... 134/3; 134/6; 134/28; 134/38; 134/41; 252/153; 252/170; 252/173; 252/548

[58] Field of Search ..... 252/118, 153, 173, 529, 252/548, DIG. 14, DIG. 8; 134/38, 40, 39, 20

[56] References Cited

U.S. PATENT DOCUMENTS

| | | | |
|---|---|---|---|
| 2,548,766 | 4/1951 | Baum et al. | 252/118 |
| 4,251,383 | 2/1981 | Kemp | 252/118 |
| 4,445,940 | 5/1984 | Hulford et al. | 252/89.1 |

FOREIGN PATENT DOCUMENTS 572491 12/1977 U.S.S.R. .

*Primary Examiner*—Paul Lieberman
*Assistant Examiner*—John F. McNally

[57] ABSTRACT

A liquid phase cleaner-solvent consisting essentially of from about 50% to about 90% by weight of water, less than 10% by weight of sodium chloride, from about ½ to 1% to about 10% by weight of coconut amide, from about ½ of 1% to about 8% by weight of a tall oil fatty acid, from about 1% to about 15% by weight of isopropyl alcohol and from about 5% to about 40% by weight of propylene carbonate and a process for removing oxidation from metal surfaces using the liquid phase cleaner-solvent.

15 Claims, No Drawings

LIQUID PHASE CLEANER-SOLVENT

BACKGROUND OF THE INVENTION

1. Field of the Invention

This invention relates to chemical cleaners and to chemical solvents.

2. Description of the Prior Art

Solvents and other chemical compounds are known for use in removing unwanted films such as grease, burned on carbon, paint and varnish coatings, rust and other forms of oxidation, ink and other organic staining media from various surfaces.

Hot caustic solutions and cold acid combinations such as phosphoric acid, citric acid and muriatic acid are known for use as rust removers. These products typically require from fifteen minutes to one hour to remove rust accumulation from a surface of interest.

Hot akaline dip solutions and combinations of chlorinated, aromatic, ketone or aliphatic solvents, phenols and phenol derivatives are used as paint strippers. Most of these are not effective in removing latex paints since latex has a tendency to gum and adhere when these are used in an attempt to remove latex paint.

Caustic cleaners and acid cleaners are known to clean aluminum and to remove oxide therefrom.

For ink removal, blends of ketone, aliphatic, aromatic or chlorinated solvents are used. To clean carburetors by dissolving varnish resulting from gasoline evaporation, hot caustic dips, cold chlorinated solvents and cold phenol derivatives are known. For copper and brass cleaners, acid solutions and alkaline baths are known. As concrete cleaners, strong acid washes and alkaline washes are known.

OBJECTS OF THE INVENTION

It is a principal object of this invention to provide a safe, nonpolluting, nonflammable liquid to clean, strip, emulsify and brighten surfaces in a selective manner whereby the amount of agitation and shear force applied to the liquid and the surface controls the amount of unwanted material removed from the surface.

SUMMARY OF THE INVENTION

This invention provides an environmentally safe liquid cleaner and solvent having cleaning and solvent properties equal to or better than the known chlorinated, aliphatic, aromatic, ketone, acidic and akali materials used for dissolving, finishing and brightening metals, cleaning masonry, removing rust and emulsifying solids particularly concrete. The invention contains no aromatic, aliphatic, chlorinated or ketone solvents nor any acids, caustics or alkalies. The invention maintains a constant pH of 7 and is not irritating to normal skin. The liquid cleaner-solvent of the invention is nonflammable at least to its boiling point and gives off no noxious fumes, in contrast to many of the known liquid cleaner-solvents. The liquid cleaner-solvent of the invention may also be used for brightening nonferous metals such as copper, brass, silver etc. by placing the liquid cleaner-solvent of the invention on a selected surface for a minute or more. No wiping or stropping action need be applied. Once the liquid cleaner-solvent of the invention has been removed, the surface may be further shined and brightened by wiping with a cloth or a mildly abrasive wiping material.

The liquid cleaner-solvent of the invention is preferably formulated of water, sodium chloride, coconut amide, tall oil fatty acid, isopropyl alcohol and propylene carbonate. The formulation may vary according to the severity of service in which the liquid cleaner-solvent will be used. Water may preferably be from about fifty percent (50%) to about ninety percent (90%) by weight of the total ingredients, sodium chloride may be from about zero (0%) to about ten percent (10%) by weight of the total ingredients, the coconut amide may be from about one half of one percent (0.5%) to about ten percent (10%) by weight of the total ingredients, the tall oil fatty acid may be from about one half of one percent (0.5%) to about eight percent (8%) by weight of the total ingredients, highly pure isopropyl alcohol may be from about one half of one percent (0.5%) to about fifteen percent (15%) by weight of the total ingredients and propylene carbonate may be from about five percent (5%) to about forty percent (40%) by weight of the total ingredients.

DESCRIPTION OF THE PREFERRED EMBODIMENTS AND BEST MODE KNOWN FOR PRACTICING THE INVENTION

This invention provides a liquid cleaner-solvent believed to be environmentally safe, noncarcinogenic, nonflammable and nontoxic, for cleaning aluminum, removing ink, removing latex paints, removing rust, cleaning other nonferrous metals, cleaning concrete and the like.

The preferred embodiment of the liquid cleaner-solvent of the invention is a mixture of 5.33 pounds of warm water, 0.5 pounds of sodium chloride, 0.68 pounds of coconut amide, 0.055 pounds of tall oil fatty acid, 0.56 pounds of 99% pure isoprophl alcohol and 1.84 pounds of propylene carbonate; this formulation provides one gallon, or about 8.965 pounds, of the liquid cleaner-solvent of the invention.

Ordinary water and sodium chloride are preferably used in formulating the invention. The coconut amide preferably used in formulating the invention is preferably diethanol amine and is available from Ardmore Chemical Company, Inc., under the trademark Ardette DC and is also available from other sources listed in the McCutcheon Guide, 1984 edition.

A preferred tall fatty acid is available under the trademark Pamak 4 from Hercules, Inc. in Wilmington, Del. Other suitable tall oil fatty acids are available from Union Camp Company, Arizona Chemical Company, Reichold Chemical Company and Emery Industries. While grade 4 is preferred, other grades such as grade 2, grade 4A and grade 6 may also be used; these grades signify the amount of oleic and linoleic acids as a percentage of the rosin acid in the basic formulae.

The isopropol alcohol may be seventy percent (70%), ninety-one percent (91%) or ninety-nine percent (99%) pure; ninety-nine percent (99%) pure is preferred. The isopropol alcohol is available from from Shell Chemical Company, Ashland Chemical Company, Union Carbide Chemical Company, Eastman Kodak Chemical Company and others.

The propylene carbonate used in the liquid cleaner-solvent of the invention is available from the Jefferson Chemical Division of Texaco and from Ashland Chemical Company, AC Industries, Satva Chemical Division of Chugai International Corporation and from Nippon Soda Limited.

The liquid cleaner-solvent of the invention is preferably manufactured according to the following procedure: Warm water is placed in a metal or plastic tank having a source of slow agitation. The sodium chloride is slowly added followed by the coconut amide, the tall oil fatty acid, the isopropyl alcohol and the propylene carbonate, where each ingredient is added sequentially and slowly, while the mixture is maintained under constant slow agitation for at least five minutes. Once this agitation has been performed, the ingredients are sufficiently mixed to provide a uniform consistency throughout the liquid cleaner-solvent embodying the invention. This procedure has been used repeatedly and consistently to manufacture the liquid cleaner-solvent embodying the preferred embodiment of the invention set forth above.

Other useful embodiments of the invention have been found to include the coconut amide up to about ten percent (10%) by weight and as low as six percent (6%) by weight without adversely affecting the properties of the liquid cleaner solvent of the invention. The tall oil fatty acid has been as high as two percent (2%) by weight of the liquid cleaner solvent of the invention without adversely affecting the results obtained when using the invention. Similarly, the isopropyl alcohol has been as high as ten percent (10%) by weight of the liquid cleaner solvent of the invention and the propylene carbonate has been as high as thirty percent (30%) by weight of the liquid cleaner solvent of the invention.

It is believed that the invention may be successfully formulated where water is anywhere from fifty percent (50%) to ninety percent (90%) by weight of the liquid cleaner-solvent of the invention. Similarly, it is believed that sodium chloride can range from zero percent (0%) by weight to about ten percent (10%) by weight of the liquid cleaner-solvent embodying the invention. It is believed that the coconut amide can range from about one-half of one percent (0.5%) to about ten percent (10%) by weight of the liquid cleaner-solvent embodying the invention. It is believed that the tall oil fatty acid can range from about one-half of one percent (0.5%) to about eight percent (8%) by weight of the liquid cleaner-solvent embodying the invention. It is believed that the isopropyl alcohol can range from about one-half of one percent (0.5%) to about fifteen percent (15%) by weight of the liquid cleaner-solvent embodying the invention. Finally it is believed that the propylene carbonate can range from about five percent (5%) to about forty percent (40%) by weight of the liquid cleaner-solvent embodying the invention.

Liquid cleaner-solvent embodying the invention can be used to clean concrete, replacing muriatic acid. The liquid cleaner-solvent embodying the invention also can be used in tool clean up, it appears to have some waterproofing effect on porous surfaces. The liquid cleaner-solvent embodying the invention may also be used as a paint stripper and as a graffiti remover and is particularly adaptable to be used for cleaning truck, train and bus exteriors due to its selective removal characteristic whereby it is possible to remove a top layer of graffiti, paint or marking pen ink without affecting the base layer of preservative applied to the surface.

The liquid cleaner-solvent embodying the invention has been found to completely remove baked-on varnish deposits from engines and carburetors in minutes. As a rust remover the liquid cleaner-solvent embodying the invention emulsifies heavy rust deposits almost immediately and is equally effective at removing grease, gun blue and drawing compounds from metal. The liquid cleaner-solvent embodying the invention dissolves aluminim oxides and other oxide from aluminum and imparts a mirror-like finish to many metals.

The liquid-cleaner solvent embodying the invention removes self-adhesive glue, caulk, isocyanates, epoxies, hardened soap and detergent deposits, lime deposits, baked on food, spots from fabrics and stain from brick. The liquid cleaner-solvent embodying the invention removes surface fibers from rough wood, thereby imparting a sealed, highly polished sheen to the wood surface. When used on glass the liquid cleaner-solvent embodying the invention, applied with light, rapid strokes, results in mechanical etching and penetration of the glass surface.

The utility of the invention and the surprising results obtained when using same are especially evident from the following working examples:

EXAMPLE 1

A liquid cleaner-solvent embodying the invention was formulated by placing 5.33 pounds of warm water in a beaker having a mechanical stirrer therewithin. Slowly and sequentially 0.50 pounds of sodium chloride, 0.68 pounds of coconut amide, 0.055 pounds of tall oil fatty acid, 0.56 pounds of 99% pure isopropyl alcohol and 1.84 pounds of propylene carbonate were added. The resulting mixture was slowly mixed by the mechanical stirrer in the beaker for about five minutes whereupon the resulting liquid cleaner-solvent embodying the invention was removed.

The resulting liquid cleaner-solvent embodying the invention was applied to three layers of paint—one exterior coat of latex paint covering two base coats of an oil based enamel which had been applied to oak wood. The liquid cleaner-solvent embodying the invention was applied thinly, with a paint brush, and allowed to stand on the painted surface for fifteen minutes. The three layers of paint were softened sufficiently so that they could be easily removed with a paint scraper. Fine steel wool and water were used to remove a slight residue that remained. Bare wood resulted. The bare wood was repainted successfully the next day with two coats of latex semigloss paint. Over twelve months the new latex semigloss paint adhered extremely well to the bare oak wood surface.

EXAMPLE 2

Liquid cleaner-solvent embodying the invention was prepared as described in Example 1. Aluminum covered with a white baked enamel was cleaned thoroughly with a conventional solvent and sprayed with strips of gold, brown, red and black enamel paint from various manufacturers. Strips of latex paint in brown, green, tan and yellow from various manufacturers were applied between the enamel strips. The resulting strips of paint were allowed to dry for forty-eight hours. The liquid cleaner-solvent embodying the invention was then brushed on the painted surface and allowed to remain for five minutes whereupon the latex paint strips dissolved. After an additional ten minutes had elapsed, the oil based enamel paints had dissolved. An additional application of the liquid cleaner-solvent embodying the invention was then made to the original white baked enamel substrate. After fifteen minutes the baked enamel substrate had dissolved and was easily removed.

EXAMPLE 3

Liquid cleaner-solvent embodying the invention was prepared as described in Example 1. The liquid cleaner-solvent embodying the invention was then brushed onto a concrete surface which had been splattered with paint some months previously. After fifteen minutes the liquid cleaner-solvent embodying the invention was rinsed from the surface while the surface was gently wire brushed. The surface was then flushed with clear water whereupon all of the paint splatters were removed.

EXAMPLE 4

Liquid cleaner-solvent embodying the invention was prepared as described in Example 1. The liquid cleaner-solvent embodying the invention was applied to pine wood having six coats of varnish, varnish stain and shellac on the surface. The liquid cleaner-solvent embodying the invention was permitted to remain on the varnished pine wood surface for ten minutes after which gentle scraping with a paint scraper resulted in removal of the largest portion of the varnish, varnish stain and shellac. A synthetic fiber, mildly abrasive pad, sold under the trademark "Rescue", when gently applied, removed the balance of the residue resulting in the bare pine wood being exposed. After the bare pine wood was rinsed with clear water and wiped dry with a clean cloth, the wood took on a sheen and, after some mild buffing, appeared to have been hand-rubbed with an oil or wax.

EXAMPLE 5

Liquid cleaner-solvent embodying the invention was prepared as described in Example 1. The liquid cleaner-solvent embodying the invention was brushed onto a brick surface previously vandalized by application of paint and marking pen graffiti. The liquid cleaner-solvent embodying the invention was allowed to remain on the brick surface for ten minutes after which the brick surface was brushed with a stiff bristle brush and flushed with clear water. All traces of the paint and marking pen graffiti disappeared from the surface.

EXAMPLE 6

Liquid cleaner-solvent embodying the invention was prepared as described in Example 1. The liquid cleaner-solvent embodying the invention was brushed onto a masonry and concrete surface previously vandalized by application of paint and marking pen graffiti. The liquid cleaner-solvent embodying the invention was allowed to remain on the masonry and concrete surface for ten minutes after which the masonry and concrete surface was brushed with a stiff bristle brush and flushed with clear water. All traces of the paint and marking pen graffiti disappeared from the surface.

EXAMPLE 7

Liquid cleaner-solvent embodying the invention was prepared as described in Example 1. An aluminum surface defaced with spray paint and marking pen graffiti was treated by rubbing the aluminum surface with a mildly abrasive pad of the type described in Example 4, saturated with the liquid cleaner-solvent embodying the invention. Light rubbing with the mildly abrasive pad saturated with the cleaner-solvent embodying the invention removed the unwanted paint and markings from the aluminum surface. Flushing the surface with clear water completed removal of the unwanted paint and markings.

EXAMPLE 8

Liquid cleaner-solvent embodying the invention was prepared as described in Example 1. A white fiberglass surface defaced with spray paint and marking pen graffiti was treated by rubbing with a mildly abrasive pad of the type described in Example 4 saturated with the liquid cleaner-solvent embodying the invention. Light rubbing with the mildly abrasive pad saturated with the cleaner-solvent embodying the invention removed the unwanted paint and markings from the fiberglass surface. Flushing the surface with clear water completed removal of the unwanted paint and markings and restored the color of the fiberglass that had discolored due to exposure to the elements.

EXAMPLE 9

Liquid cleaner-solvent embodying the invention was prepared as described in Example 1. The liquid cleaner-solvent embodying the invention was applied to a steel drum painted with white alkyd enamel. The liquid cleaner-solvent was allowed to remain on the white enamel surface for fifteen minutes after which gentle wiping the surface with a clean dry cloth removed substantially all of the white alkyd enamel paint. The surface was then rinsed with clear water resulting in removal of the remaining paint residue.

EXAMPLE 10

Liquid cleaner-solvent embodying the invention was prepared as described in Example 1. A lithography-printed can was treated by applying the liquid cleaner-solvent embodying the invention to a mildly abrasive pad of the type described in Example 4 and to very fine grade steel wool and immediately wiping the lithography-printed surface with these. This resulted in dissolution and complete removal of the lithography. In the case of one surface of the can which had varnish applied over the lithographic printing, liquid cleaner-solvent embodying the invention was applied directly and permitted to remain on the surface for ten minutes. After the ten minute period had elapsed, the surface was gently wiped with a clean dry cloth, completely removing the lithographic printing therefrom.

EXAMPLE 11

Liquid cleaner-solvent embodying the invention was prepared as described in Example 1. The liquid cleaner-solvent embodying the invention was applied to a clean dry cloth. Gentle wiping of a rusted chrome-plated surface with the clean cloth to which the cleaner-solvent embodying the invention had been applied removed all traces of rust from the surface, leaving the surface highly polished. The rust was removed immediately; it was not necessary to apply the cleaner-solvent embodying the invention to the surface in advance, prior to wiping with the cloth to which the cleaner-solvent embodying the invention had been applied.

EXAMPLE 12

Liquid cleaner-solvent embodying the invention was prepared as described in Example 1. The liquid cleaner-solvent embodying the invention was applied to a clean dry cloth. Gentle wiping of a rusted magnesium alloy surface with the clean cloth to which the cleaner-solvent embodying the invention had been applied removed all traces of rust and oxidation from the surface, leaving the surface highly polished. The rust and oxidation was removed immediately; it was not necessary to apply the cleaner-solvent embodying the invention to the surface in advance, prior to wiping with the cloth to which the cleaner-solvent embodying the invention had been applied.

EXAMPLE 13

Liquid cleaner-solvent embodying the invention was prepared as described in Example 1. The liquid cleaner-solvent embodying the invention was applied to a fabric of unknown material stained with rust. The stained portion of the fabric to which the liquid cleaner-solvent embodying the invention had been applied was rubbed against itsself and rinsed with cool water. The rust stains were carried away and disappeared upon the rinsing with the cool water.

EXAMPLE 14

Liquid cleaner-solvent embodying the invention was prepared as described in Example 1. The liquid cleaner-solvent embodying the invention was applied to a fine steel wool pad. The fine steel wool pad carrying the liquid cleaner-solvent embodying the invention was used to gently wipe a steel surface which was heavily rusted due to exposure to the elements for a number of years. Gentle wiping removed the rust by liquifying it and imparted a shiny finish to the exposed steel surface.

EXAMPLE 15

Liquid cleaner-solvent embodying the invention was prepared as described in Example 1. The liquid cleaner-solvent embodying the invention was applied to a heavily rusted steel surface. The blunt edge of a penknife was then used to remove the rust from the steel surface. Mild stropping of the penknife against the steel surface liquified and removed the rust. Further stropping of the penknife against the steel surface produced a mirror-like sheen on both the steel surface and the penknife blade. The appearance of the surfaces was similar to that of molten metal.

EXAMPLE 16

Liquid cleaner-solvent embodying the invention was prepared as described in Example 1. The liquid cleaner-solvent embodying the invention was applied to heavily oxidized copper, brass and aluminum surfaces. The blunt edge of a penknife was then used to remove the oxidation from the copper, brass and aluminum surfaces. Mild stropping of the penknife against the copper, brass and aluminum surfaces liquified and removed the oxidation. Further stropping of the penknife against the copper, brass and aluminum surfaces produced a mirror-like sheen on the copper, brass and aluminum surfaces and on the penknife blade. The appearance of the surfaces was similar to that of molten metal.

EXAMPLE 17

Liquid cleaner-solvent embodying the invention was prepared as described in Example 1. The liquid cleaner-solvent was applied to badly oxidized lead. The badly oxidized lead surface having the liquid cleaner-solvent applied thereto was stropped with the flat side of a knife blade resulting in removal of the oxidation. The stropped lead surface took on a mirror-like appearance as the oxidation was removed. Some residue of the cleaner-solvent embodying the invention remained on the surface. After a six month period had elapsed, during which the lead surface was exposed to atmosphere and hence had the opportunity to oxidize, the surface retained a mirror-like appearance.

EXAMPLE 18

Liquid cleaner-solvent embodying the invention was prepared as described in Example 1. The liquid cleaner-solvent embodying the invention was applied to a steel bolt which was heavily rusted due to exposure to the elements. The steel bolt was stropped with the flat side of a knife blade resulting in removal of the rust and oxidation. A slight residue of the cleaner-solvent embodying the invention remained on the bolt surface. After six months of continuous exposure to the elements the bolt did not exhibit any recurring rust or oxidation.

EXAMPLE 19

Liquid cleaner-solvent embodying the invention was prepared as described in Example 1. Wrought iron, which was heavily rusted due to exposure to the elements for six years, was wiped with a mildly abrasive pad of the type described in Example 4, to which the liquid cleaner-solvent embodying the invention had been applied. Gentle wiping with the mildly abrasive pad removed the rust from the wrought iron. A portion of the area from which the rust was removed was stropped with the blunt edge of a knife, producing a mirror-like finish on the wrought iron. After seven months the portion of the wrought iron which was merely wiped with the mildly abrasive pad to which the cleaner-solvent embodying the invention had been applied showed no evidence of rust. The area of the wrought iron which had been stropped retained the mirror-like finish after seven months had elapsed.

EXAMPLE 20

Liquid cleaner-solvent embodying the invention was prepared as described in Example 1. Aluminum which had been exposed to the elements for twenty years and as a result was heavily oxidized was treated by light rubbing with a mildly abrasive pad of the type described in Example 4, to which the liquid cleaner-solvent embodying the invention had been applied. Light rubbing rapidly liquified and removed the aluminum oxidation, resulting in a bright aluminum surface. The bright aluminum surface was exposed to the elements for seven months with no oxidation appearing.

EXAMPLE 21

Liquid cleaner-solvent embodying the invention was prepared as described in Example 1. Brass and copper which had been exposed to the elements for twenty years and as a result were heavily oxidized were treated by light rubbing with a mildly abrasive pad of the type described in Example 4, to which the liquid cleaner-solvent embodying the invention had been applied. Light rubbing rapidly liquified and removed the brass and copper oxidation resulting in bright brass and copper surfaces. The bright brass and copper surfaces were exposed to the elements for seven months with no oxidation appearing.

EXAMPLE 22

Liquid cleaner-solvent embodying the invention was prepared as described in Example 1. The liquid cleaner-solvent embodying the invention was applied to a clean, dry cloth. The cloth was used to gently wipe food wrappers, milk cartons, foils, magazine pages, silk-screened cloth, price marks on food products and printed paper labels including web heat offset printing inks. In each case the inks were removed from the substrates without damage to the substrates.

EXAMPLE 23

Liquid cleaner-solvent embodying the invention was prepared as described in Example 1. The liquid cleaner-solvent embodying the invention was then applied to a concrete surface. Upon brushing the concrete surface with a wire brush the concrete appeared to emulsify and then became very smooth to the touch. After rain the treated area of the concrete appeared to dry five times faster than untreated concrete thereby evidencing greater resistance to water penetration than untreated concrete.

EXAMPLE 24

Liquid cleaner-solvent embodying the invention was prepared as described in Example 1. The liquid cleaner-solvent embodying the invention was applied to a concrete surface. A penknife blade was used to abrade the surface, with the concrete surface emulsifying. Continued abrasion with the penknife blade produced an indentation in the concrete surface of the type normally seen if the concrete were only partially cured instead of completely cured. For nine months the treated area of the concrete was exposed to the elements. After rain the treated area of the concrete appeared to dry five times faster than the untreated area of the concrete thereby evidencing greater resistance to water penetration than untreated concrete.

EXAMPLE 25

Liquid cleaner-solvent embodying the invention was prepared as described in Example 1. The liquid cleaner-solvent embodying the invention was applied to a masonry and brick surface. A wire brush was used to abrade the surface for about two minutes after which the surface was rinsed thoroughly with cool water and allowed to dry overnight. The next day droplets of water were applied to the portion of the masonry and brick surface to which the liquid cleaner-solvent embodying the invention had been applied and which had been abraded. Droplets of water were also applied to an untreated area of the masonry and brick surface. In the treated area of the masonry and brick surface the water droplets retained their shape and remained on the surface as beads for at least one hour before penetrating the surface. The untreated areas of the masonry and brick surface absorbed the water almost immediately upon application.

EXAMPLE 26

Liquid cleaner-solvent embodying the invention was prepared as described in Example 1. The liquid cleaner-solvent embodying the invention was applied to a brick surface exhibiting heavy effloresence. The surface was gently rubbed with a stiff wire brush and rinsed with cold water whereupon all traces of the effloresence disappeared.

EXAMPLE 27

Liquid cleaner-solvent embodying the invention was prepared as described in Example 1. The liquid cleaner-solvent embodying the invention was applied to a rust-stained masonry and concrete surface. Gentle application of a stiff wire brush to the masonry and concrete surface followed by rinsing with clear water completely removed the rust stains from the surface.

EXAMPLE 28

Liquid cleaner-solvent embodying the invention was prepared as described in Example 1. The liquid cleaner-solvent embodying the invention was applied to smooth anthracite coal whereupon the coal surface, to which the liquid cleaner-solvent had been applied, was rubbed with the convex bottom bowl of a teaspoon. After about two minutes of rubbing, graphite-like particles appeared in the liquid cleaner-solvent embodying the invention on the coal surface, resulting in a slurry. A magnet was positioned close to the slurry and picked up some magnetic particles which apparently had been released from the coal surface.

EXAMPLE 29

Liquid cleaner-solvent embodying the invention was prepared as described in Example 1. A piece of anthracite coal was placed in the liquid cleaner-solvent embodying the invention for seventy-two hours. After removal of the coal from the liquid cleaner-solvent embodying the invention, light tapping broke the coal into granules, rather than slivers, which would normally be expected. The tapping which broke the coal into granules was a much lower magnitude force than normally required to break coal.

EXAMPLE 30

Liquid cleaner-solvent embodying the invention was prepared as described in Example 1. The liquid cleaner-solvent embodying the invention was applied to a glass mirror. The surface of the mirror to which the liquid cleaner-solvent had been applied was gently rubbed with a screwdriver blade. After fifteen strokes the screwdriver blade began to penetrate the mirror surface. With continued rubbing the mirror surface continued to abrade until a break appeared in the mirror surface whereupon rubbing with the screwdriver blade was halted. When inspected with a magnifying glass small particles of the mirror surface were floating in the liquid cleaner-solvent on the mirror surface. Continued rubbing with the screwdriver blade developed a hole in the mirror. When inspected using a magnifying glass the hole appeared as a smooth, rounded hole and not as a sharp, jagged cut in the glass, which would normally be expected.

I claim:

1. An liquid aqueous cleaner-solvent consisting essentially of from about 50% to about 90% by weight of water, less than about 10% by weight of sodium chloride, from about ½ of 1% to about 10% by weight of coconut amide, from about ½ of 1% to about 8% by weight of a tall oil fatty acid, from about 1% to about 15% by weight of isopropyl alcohol and from about 5% to about 40% by weight of propylene carbonate said components constituting essentially 100 weight percent of the cleaner-solvent.

2. The cleaner-solvent of claim 1 further comprising sodium chloride.

3. The cleaner-solvent of claim 2 wherein water is about 59.4% by weight of the cleaner-solvent, sodium chloride is about 5.5% by weight of the cleaner-solvent, coconut amide is about 7.6% by weight of the cleaner-solvent, tall oil fatty acid is about 0.6% by weight of the cleaner-solvent, isopropyl alcohol is about 6.2% by weight of the cleaner-solvent, and propylene carbonate is about 20.5% by weight of the cleaner-solvent.

4. The liquid cleaner-solvent of claim wherein water is from about 50% to about 90% by weight of the cleaner-solvent.

5. The liquid cleaner-solvent of claim 3 wherein sodium chloride is no greater than about 10% by weight of the liquid cleaner-solvent.

6. The liquid cleaner-solvent of claim 3 wherein coconut amide is from about 0.5% to about 10% by weight of the liquid cleaner-solvent.

7. The liquid cleaner-solvent of claim 3 wherein tall oil fatty acid is from about 0.5% to about 8% by weight of the liquid cleaner-solvent.

8. The liquid cleaner-solvent of claim 3 wherein isopropyl alcohol is from about 0.5% to about 15% by weight of the liquid cleaner-solvent.

9. The liquid cleaner-solvent of claim 3 wherein propylene carbonate is from about 5% to about 40% by weight of the liquid cleaner-solvent.

10. A method for removing oxidation products from metal surfaces comprising:

(a) preparing an aqueous cleaner-solvent consisting essentially of from about 50% to about 90% by weight of water, less than about 10% by weight of sodium chloride, from about ½ of 1% to about 10% by weight of coconut amide, from about ½ of 1% to about 8% by weight of a tall oil fatty acid, from about ½ of 1% to about 15% by weight of highly pure isopropyl alcohol and from about 5% to about 40% by weight of propylene carbonate by sequentially adding the sodium chloride, the coconut amide, the tall oil fatty acid, the isopropyl alcohol and the propylene carbonate to the water while slowly agitating the water said components constituting essentially 100 weight percent of the cleaner-solvent and (b) applying the resulting liquid cleaner-solvent to a metal surface fo period sufficiently long to dissolve oxidation products from the surface.

11. The method of claim 10 further comprising the step of flushing the surface with clear water after the oxidation has dissolved.

12. The method of claim 10 further comprising the step of stropping the metal surface with a blunt metal object after the liquid cleaner-solvent has been applied to the oxidized surface.

13. The method of claim 12 further comprising the step of rinsing the metal surface with clear water upon the conclusion of the stropping step.

14. The method of claim 10 further comprising the step of vigorously brushing the metal surface after the liquid cleaner-solvent is applied thereto.

15. The method of claim 10 further comprising applying the liquid cleaner-solvent to the metal surface by gentle wiping with a clean cloth soaked with the liquid cleaner-solvent.

* * * * *